US006679309B2

(12) United States Patent
Hsu

(10) Patent No.: US 6,679,309 B2
(45) Date of Patent: Jan. 20, 2004

(54) VARIED FABRIC BLIND

(75) Inventor: Pey-Son Hsu, Changhua Hsien (TW)

(73) Assignee: Ching Feng Blinds Ind. Co., Ltd. (TW)

( * ) Notice: Subject to any disclaimer, the term of this patent is extended or adjusted under 35 U.S.C. 154(b) by 0 days.

(21) Appl. No.: 10/121,686

(22) Filed: Apr. 15, 2002

(65) Prior Publication Data

US 2003/0221795 A1 Dec. 4, 2003

(51) Int. Cl.[7] ..... A47H 5/00
(52) U.S. Cl. ..... 160/84.01
(58) Field of Search ..... 160/84.01, 84.03, 160/84.04, 84.07, 330, 340

(56) References Cited

U.S. PATENT DOCUMENTS 1,084,781 A * 1/1914 Behrle ..... 160/84.01
2,295,137 A * 9/1942 Sutton ..... 160/84.01
4,765,388 A * 8/1988 Dohlemann ..... 160/348 X
4,953,610 A * 9/1990 Phillips et al. ..... 160/84.03
4,976,301 A * 12/1990 Easley et al. ..... 160/84.01
5,139,069 A * 8/1992 Hong ..... 160/84.01
5,197,526 A * 3/1993 Schon ..... 160/84.01
5,207,257 A * 5/1993 Rupel et al. ..... 160/84.01
5,662,147 A * 9/1997 Haiber ..... 160/84.01 X
5,787,951 A * 8/1998 Tonomura et al. ..... 160/84.01

* cited by examiner

*Primary Examiner*—David Purol
(74) *Attorney, Agent, or Firm*—Bacon & Thomas, PLLC

(57) ABSTRACT

A varied fabric blind drapery is made up of an upper beam, a fabric drapery fastened to the underside of said upper beam, and two cord fixing seats disposed at both sides of said upper beam respectively wherein one cord fixing seat is provided with a pull cord while the other with two pull cords. The fabric drapery, a rectangular body of proper width, has a plurality of cord passing holes integrally woven by the weft and warp yarns thereof for the pull cord disposed at one cord fixing seat thereof to be led through one by one at the central line thereof and the two pull cords at the other cord fixing seat to be led from both left and right sides thereof, each extending downwards to be tied up into a fixing knot at the bottom thereof; whereby, either the one pull cord or the two pull cords thereof can be drawn respectively to lead up the fixing knots thereof, thus easily and quickly change the drapery display for variation. Moreover, the number of said pull cords thereof can be added up to, for example, two for each cord fixing seat to permit a variety of drapery display for variation. Or linking ropes fastened to both lateral sides of said fabric drapery by knots and tied up to said pull cord by linking joints are provided to produce wave-like folds displayed at both lateral sides of said fabric drapery for more variations.

3 Claims, 3 Drawing Sheets

VARIED FABRIC BLIND

BACKGROUND OF THE INVENTION

The present invention is related to a varied fabric blind drapery, having an upper beam, a fabric drapery fastened to the underside of said upper beam, and two cord fixing seats disposed at both sides of said upper beam respectively wherein one cord fixing seat is provided with a pull cord while the other with two pull cords. The fabric drapery, a rectangular body of proper width, has a plurality of cord passing holes integrally woven by the weft and warp yams thereof for the pull cords to be led through and tied up into knots at the bottom thereof; whereby, the pull cords can be drawn to lead up the fixing knots thereof, thus easily and quickly change the drapery display for variation. Moreover, the number of the pull cords can be added to permit a variety of drapery display for variation. Or linking ropes attached to said pull cord with linking joints are provided to produce a wave-like pattern at both lateral sides of said fabric drapery for more variation.

Please refer to FIG. 1 showing a conventional fabric blind drapery in operation. A conventional fabric blind drapery is made up of an upper beam 11 and a pull cord 12 disposed at one side of said upper beam 11 wherein said pull cord 12 is provided with a plurality of adjustable linking hooks 13, each having a fixing ring 15 disposed below at one end to be attached with a fabric drapery body 14 divided into two pieces. Said pull cord 12 is applied to control the open or close movement of said fabric drapery body 14 thereof via said linking hooks 13 with said fixing rings 15.

There are several drawbacks to such conventional fabric blind drapery. First, it is monotonous in the drapery display since the fabric drapery body 14 moves only crosswise from left to right with simple irregular folds displayed in the front thereof. Second, it is quite inconvenient since the fixing rings 15 attached to the fabric drapery body 14 and the linking hooks 13 disposed at the pull cord 12 might easily come off when the force of drawing said pull cord 12 is not evenly applied.

SUMMARY OF THE PRESENT INVENTION

It is, therefore, the primary purpose of the present invention to provide a varied fabric blind drapery, comprising an upper beam, a fabric drapery attached to the underside of said upper beam, two cord fixings seat disposed at both sides of said upper beam respectively, and pull cords disposed at both cord fixing seats thereof wherein said pull cords are extended to be tied up into fixing knots at the bottom of said fabric drapery; whereby said pull cords can be drawn to lead up said fixing knots thereof, raising said fabric drapery vertically with wave-like folds displayed at the bottom edge of said fabric drapery for variation.

It is, therefore, the second purpose of the present invention to provide a varied fabric blind drapery wherein said fabric drapery is provided with a plurality of cord passing holes integrally woven by the weft and warp yarns thereof for said pull cords to be led through directly and securely without the shortage of coming off easily.

It is, therefore, the third purpose of the present invention to provide a varied fabric blind drapery wherein said pull cords, when force of pulling is applied, will lead up the fixing knots thereof evenly which have said fabric drapery steadily folded up into beautiful drapery display.

DETAILED DESCRIPTION OF THE PREFERRED EMBODIMENTS

Figure 2:
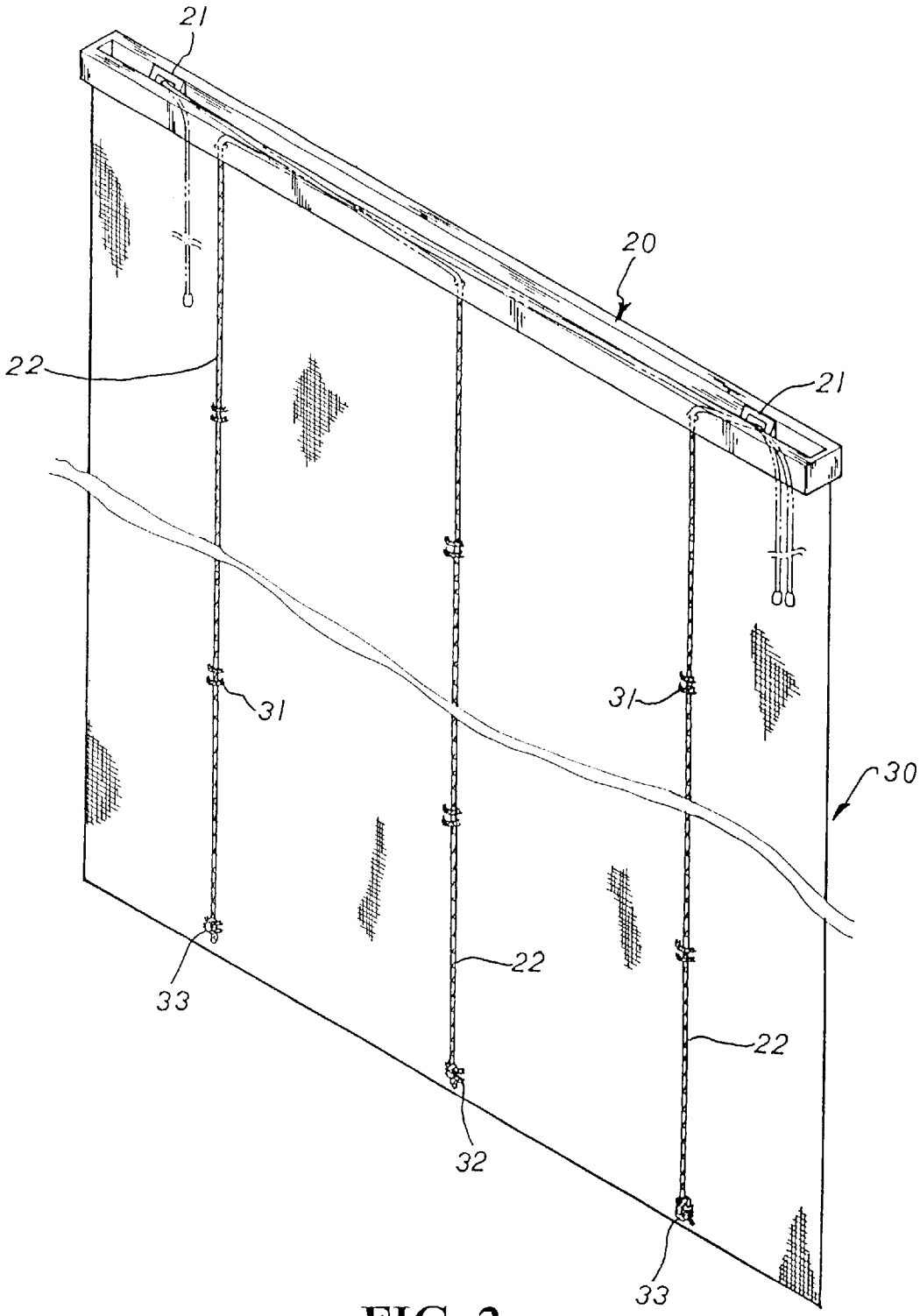
FIG. 2 is a perspective view of the present invention.

Please refer to FIG. 2 showing a perspective view of the present invention. The present invention is related to a varied fabric blind drapery, comprising an upper beam 20, a fabric drapery 30 fastened to the underside of said upper beam 20, and two cord fixing seats 21 disposed at both sides of said upper beam 20 respectively. One cord fixing seat 21 disposed at one side of the upper beam 20 thereof is provided with a pull cord 22, while the other cord fixing seat 21 disposed at the other side thereof is provided with two pull cords 22. Said fabric drapery 30 is a rectangular piece of proper width, having a plurality of cord passing holes 31 integrally woven by the weft and warp yards and distributed on the surface of said fabric drapery 30 thereof. In assembly, the pull cord 22 disposed at one cord fixing seat 21 thereof is led through the cord passing holes 31 disposed at the central line of said fabric drapery 30 one by one, extending downwards from the top to the bottom thereof to be tied up into a fixing knot 32. In similar manner, the other two pull cords 22 disposed at the other side of said upper beam 20 thereof are led through said cord passing holes 31 disposed at both left and right sides of said fabric drapery 30, each extending from either left or right side thereof downwards to be tied up into a fixing knot 32.

Figure 3:
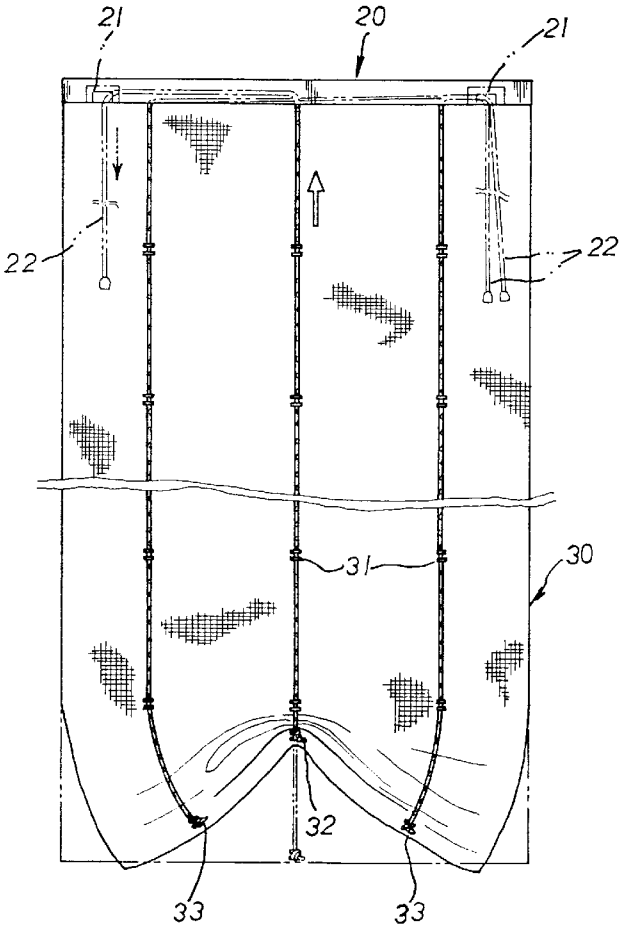
FIG. 3 is a sectional view of the present invention in operation.

Please refer to FIG. 3 showing a sectional view of the present invention. In operation, the pull cord 22 disposed at one side of the upper beam 20 thereof is drawn to lead up the fixing knot 32 disposed at the central bottom of said fabric drapery 30 and thus raise said fabric drapery 30 by a central line thereof, forming a drapery display wherein the central line thereof is higher than both left and right sides of the fabric drapery 30 thereof as shown in FIG. 3. Alternatively, the two pulling cords disposed at the other side of said upper beam 20 thereof can be drawn to lead up the fixing knots 33 disposed at the left-and-right side bottom of the fabric drapery 30, raising the said fabric drapery 30 at both sides to vary the drapery display as shown in FIG. 3.

Figure 4:
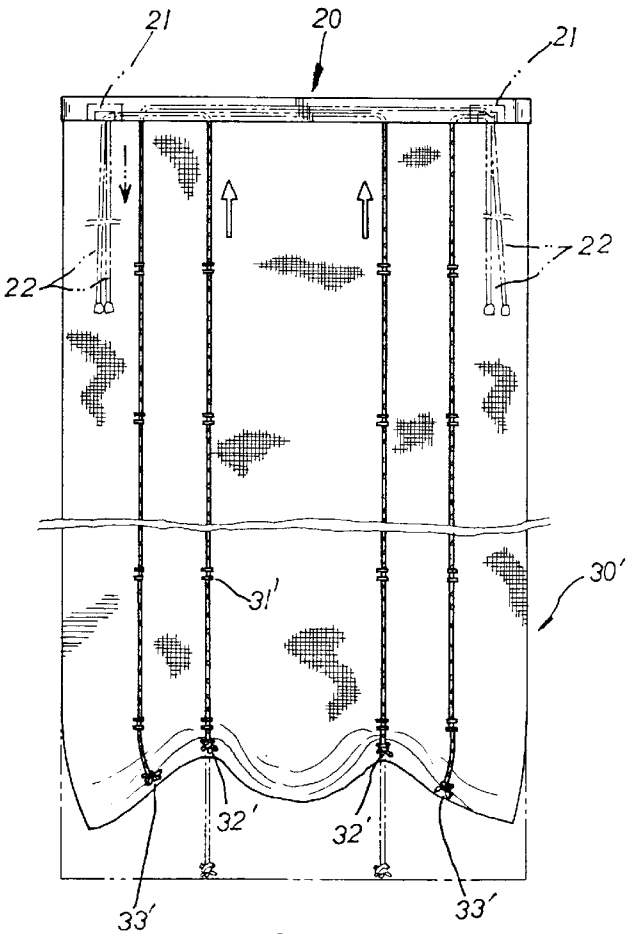
FIG. 4 is a diagram showing another embodiment of the present invention.

Please refer to FIG. 4 showing another embodiment of the present invention. The underside of said upper beam 20 is engaged with another fabric drapery 30' and a cord fixing seat 21 is disposed at each side of the upper beam 20 thereof wherein each cord fixing seat 21 is provided with two pull cords 22. In assembly, the two pull cords 22 thereof disposed at one cord fixing seat 21 are led through the cord passing holes 31' disposed at the middle section of the fabric drapery 30',each extending downwards to be tied up into a fixing knot 32' at the bottom thereof, while the two pull cord 22 disposed at the other cord fixing seat 21 are led through the cord passing holes 31' disposed at both left and right sides of the fabric drapery 30' thereof, each extending downwards to be tied up into a fixing knot 32' at the bottom thereof.

In operation, the two pull cords 22, led through the cord passing holes 31' disposed at the middle of the fabric drapery 30' thereof, are drawn, leading up the two fixing knots 32' disposed at the middle bottom of the fabric drapery 30' thereof to form wave-like folds in the drapery display as shown in FIG. 4.

Figure 5:
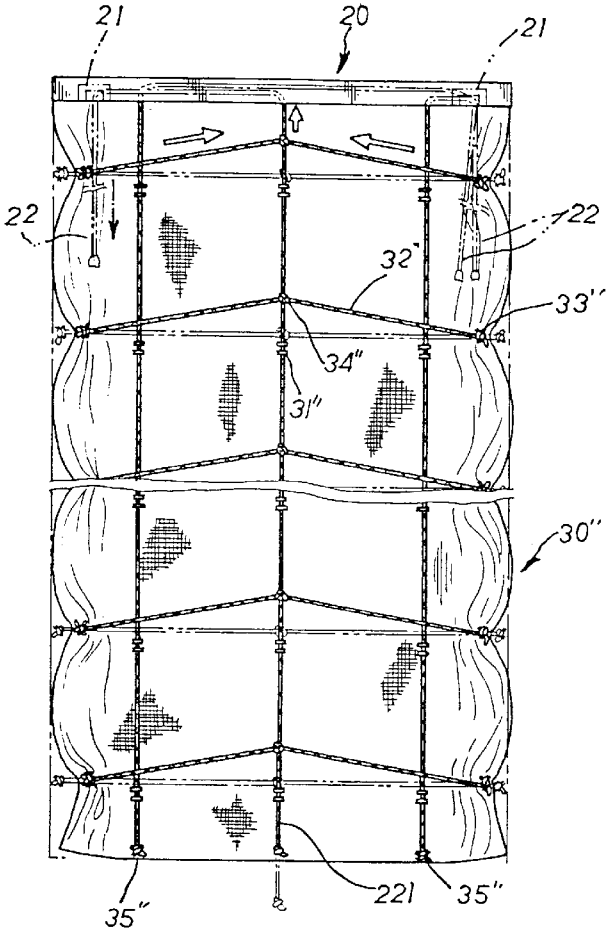
FIG. 5 is a diagram showing a third embodiment of the present invention.
Figure 1:
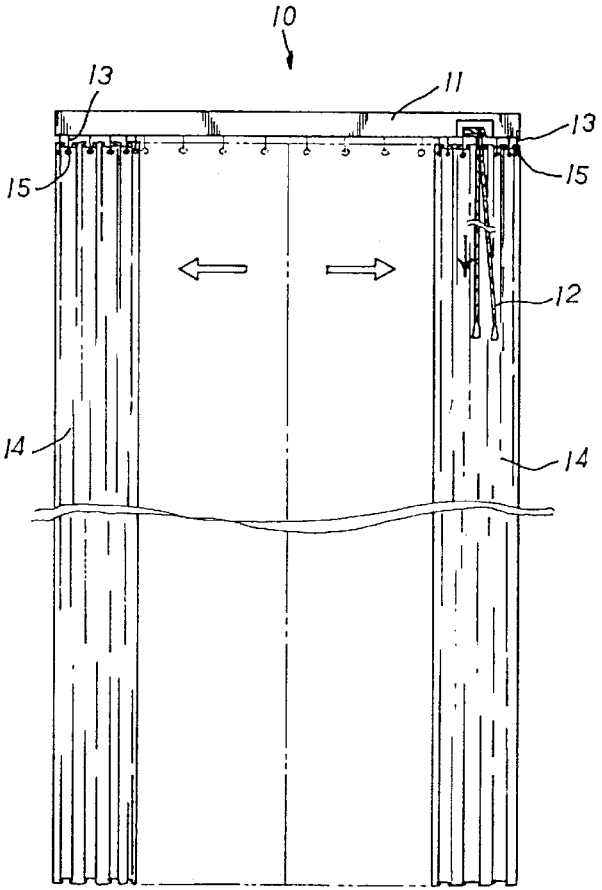
FIG. 1 PRIOR ART
FIG. 1 is a diagram showing the conventional fabric blind drapery in operation.

Please refer to FIG. 5 showing a third embodiment of the present invention. The underside of the upper beam 20 is engaged with the fabric drapery 30" and each side of the upper beam 20 is provided with a cord fixing seat 21 wherein one fixing seat 21 thereof is provided with a pull cord 22 and the other fixing seat 21 thereof is provided with two pull cords 22. In assembly, a plurality of linking ropes 32" equidistantly and horizontally disposed at the cord passing holes 31" thereof are fastened to both lateral sides of said fabric drapery 30" by knots 33". The pull cord 22 disposed at one side of the upper beam 20 is led through the cord passing holes 31" disposed at the central line of said fabric drapery 30 one by one, tying up with each of said linking ropes 32" to form a linking joint 34" when extending downwards to leave an extra flexible pull cord section 221 disposed lower than the bottom of said fabric drapery 30". The two pull cords 22 disposed at the other side of said upper beam 20 are led through the cord passing holes 31 disposed at both left and right sides of the fabric drapery 30", each extending downwards to tie up into a fixing knot 35" at the bottom thereof.

In operation, the pull cord 22 disposed at one side of said upper beam 20 is drawn, leading upwards the flexible pull cord section 221 thereof and the linking joints 34" engaging said linking ropes 32" with said pull cord 22 led through said cord passing holes 31 disposed at the central line of said fabric drapery 30". Meanwhile, the linking joints 34" thereof raised upward by said drawn pull cord 22 will bring in the knots 33" disposed at both lateral sides of the fabric drapery 30", gathering in the both lateral sides of said fabric drapery 30" thereof to produce wave-like folds in the drapery display as shown in FIG. 5.

What is claimed is:

1. A fabric blind comprising:

a fabric drapery comprising a rectangular flat body, a plurality of cord passing holes arranged in at least central and lateral columns that are positioned side-by-side along the longitudinal length of the fabric drapery, the cord passing holes are integrally woven into the fabric drapery;

central and lateral pull cords correspondingly extending into respective ones of the central and lateral columns of the cord passing holes;

an upper beam including first and second cord fixing seats;

one end of the central pull cord extends out of the first cord fixing seat and the other end thereof is secured via a fixing knot at the lowermost one of the cord passing holes of the central column of the cord passing holes;

first ends of the lateral pull cords extend out of the second cord fixing seat and the second cords thereof are secured via additional fixing knots at respective lowermost ones of the cord passing holes of the lateral columns of the cord passing holes; and wherein either the central pull cord or the lateral pull cords can be pulled in order to raise the fabric drapery and form a wave-shape pattern at the bottom of the fabric drapery.

2. The fabric draper as claimed in claim 1, further comprising one or more additional pull cords and corresponding column or columns of cord passing holes to form varied wave-shape patterns at the bottom of the fabric drapery.

3. A fabric blind comprising:

a fabric drapery comprising a rectangular flat body, a plurality of cord passing holes arranged in at least central and lateral columns that are positioned side-by-side along the longitudinal length of the fabric drapery, the cord passing holes are integrally woven into the fabric drapery;

central and lateral pull cords correspondingly extending into respective ones of the central and lateral columns of the cord passing holes;

an upper beam including first and second cord fixing seats;

one end of the central pull cord extends out of the first cord fixing seat and the other end thereof includes a fixing knot positioned below the lowermost one of the cord passing holes of the central column of the cord passing holes;

first ends of the lateral pull cords extend out of the second cord fixing seat and the second cords thereof are secured via additional fixing knots at respective lowermost ones of the cord passing holes of the lateral columns of the cord passing holes; and a plurality of horizontally arranged linking ropes, the ends of which are secured to respective lateral edges of the fabric drapery, and the linking ropes are further secured to the central pull cord via linking joints disposed above corresponding ones of the cord passing holes, such that when the central pull cord is pulled, the linkage ropes are pulled by the central pull cord and the lateral edges of the fabric drapery to which the linking ropes are attached, are pushed towards the central pull cord, thereby forming wave-shape patterns on lateral edges of the fabric drapery.

* * * * *